US010060198B2

(12) United States Patent
Garcia et al.

(10) Patent No.: US 10,060,198 B2
(45) Date of Patent: Aug. 28, 2018

(54) ISOLATION PACKER WITH AUTOMATICALLY CLOSING ALTERNATE PATH PASSAGES

(71) Applicant: Baker Hughes Incorporated, Houston, TX (US)

(72) Inventors: Andres Garcia, Houston, TX (US); Nervy E. Faria, Houston, TX (US); Britain Fisher, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 577 days.

(21) Appl. No.: 14/218,460

(22) Filed: Mar. 18, 2014

(65) Prior Publication Data

US 2015/0267517 A1 Sep. 24, 2015

(51) Int. Cl.

| | |
|---|---|
| ***E21B 43/04*** | (2006.01) |
| ***E21B 17/18*** | (2006.01) |
| ***E21B 33/12*** | (2006.01) |
| ***E21B 34/06*** | (2006.01) |

(52) U.S. Cl.

CPC ..... *E21B 17/18* (2013.01); *E21B 33/1208* (2013.01); *E21B 34/06* (2013.01); *E21B 43/04* (2013.01)

(58) Field of Classification Search

CPC ..... E21B 43/04; E21B 43/02; E21B 43/08
See application file for complete search history.

(56) References Cited

U.S. PATENT DOCUMENTS

| | | | |
|---|---|---|---|
| 5,082,052 A | 1/1992 | Jones et al. | |
| 6,298,916 B1 | 10/2001 | Tibbles et al. | |
| 6,464,007 B1 | 10/2002 | Jones | |
| 6,588,506 B2 | 7/2003 | Jones et al. | |
| 7,126,160 B2 | 10/2006 | Sun et al. | |
| 7,128,152 B2 | 10/2006 | Anyan et al. | |
| 7,147,054 B2 | 12/2006 | Wang et al. | |
| 7,296,624 B2 | 11/2007 | Rodet et al. | |
| 7,373,979 B2 | 5/2008 | Coronado et al. | |
| 7,407,007 B2 | 8/2008 | Tibbles | |
| 7,562,709 B2 | 7/2009 | Saebi et al. | |
| 7,784,532 B2 | 8/2010 | Sevre et al. | |
| 7,841,398 B2 | 11/2010 | Tibbles et al. | |
| 8,403,062 B2 | 3/2013 | Dale et al. | |
| 8,453,734 B2 | 6/2013 | Jasek et al. | |
| 8,701,765 B2 | 4/2014 | Jasek et al. | |
| 8,789,612 B2 | 7/2014 | Haeberle et al. | |
| 2010/0096119 A1 | 4/2010 | Sevre et al. | |
| 2012/0055667 A1* | 3/2012 | Ingram | E21B 33/1208 166/65.1 |
| 2012/0227986 A1 | 9/2012 | Sevre | |
| 2013/0284445 A1 | 10/2013 | Hughes | |
| 2014/0027115 A1 | 1/2014 | Sanders | |

FOREIGN PATENT DOCUMENTS

| | | |
|---|---|---|
| WO | 2011060495 A1 | 5/2011 |

* cited by examiner

*Primary Examiner* — Robert Edward Fuller

(74) *Attorney, Agent, or Firm* — Steve Rosenblatt

(57) ABSTRACT

Auxiliary conduits that run through a packer body or seal are equipped with thermally responsive valve members that with a time exposure close off the conduits to create zonal isolation across one or more packers after a gravel pack. The heat source can also be added to the well fluids to control the speed of the process either in the form of heaters or reactive chemicals that create an exothermic reaction. The valve material can be shape memory polymer.

14 Claims, 1 Drawing Sheet

ISOLATION PACKER WITH AUTOMATICALLY CLOSING ALTERNATE PATH PASSAGES

FIELD OF THE INVENTION

The field of the invention is zonal isolation across a set packer that has alternate path passages that go through its body or seal and more particularly where such closures are automatically actuated using borehole temperature.

BACKGROUND OF THE INVENTION

In the context of multiple zone isolation when gravel packing while using alternative path conduits there is a need to be able to isolate the zones on opposed sides of a set packer in open or cased hole. In doing so there is a need to seal off the alternate paths that run through the packer bodies or seals. One approach that has been tried is to introduce fluid in the wellbore that initiates a swelling response in a material that seals off the alternate paths. This approach is described in U.S. Pat. No. 7,407,007. The problem in this design is that it requires delivery to the swelling material of a fluid that will induce it to swell. The problem is that there is uncertainty if the delivered fluid has actually reached the swelling material in the individual tubes to start the process. Further, there is also a time delay issue from the onset of the circulation to the obtaining the desired result of path isolation. A variation of this design using a shifting tool to operate a valve in an auxiliary conduit is U.S. Pat. No. 7,562,709.

Also of general interest to the field of auxiliary conduits and closures associated with isolation devices or such conduits are the following: U.S. Pat. Nos. 7,126,160; 7,373,979; 7,296,624; 7,128,152; 7,784,532; 7,147,054; 6,464,007; 8,403,062; 6,588,506; 8,453,734 and 7,841,398.

The present invention closes off auxiliary conduits automatically using the heat in well fluids that is either naturally occurring or induced artificially such as by heaters or other heat sources. These and other aspects of the present invention will be more readily apparent to those skilled in the art from a review of the description of the preferred embodiment and the associated drawings.

SUMMARY OF THE INVENTION

Auxiliary conduits that run through a packer body or seal are equipped with thermally responsive valve members that with a time exposure close off the conduits to create zonal isolation across one or more packers after a gravel pack. The heat source can also be added to the well fluids to control the speed of the process either in the form of heaters or reactive chemicals that create an exothermic reaction or by other means. The valve material can be shape memory polymer.

DETAILED DESCRIPTION OF THE PREFERRED EMBODIMENT

Figure 1:
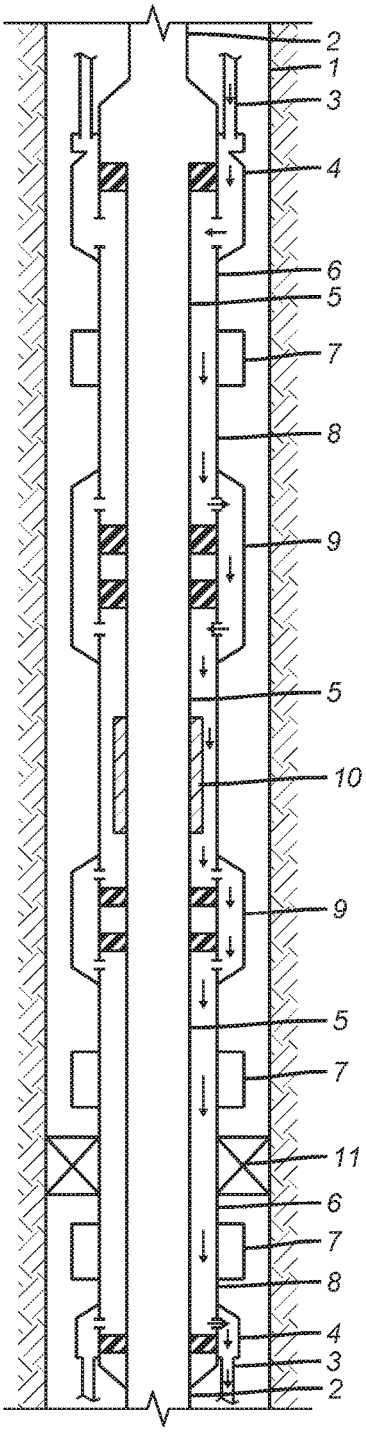
FIG. 1 is a schematic representation of a gravel packing assembly showing the auxiliary conduit with the closure in the conduit in the open position for multizone gravel packing.
Figure 2:
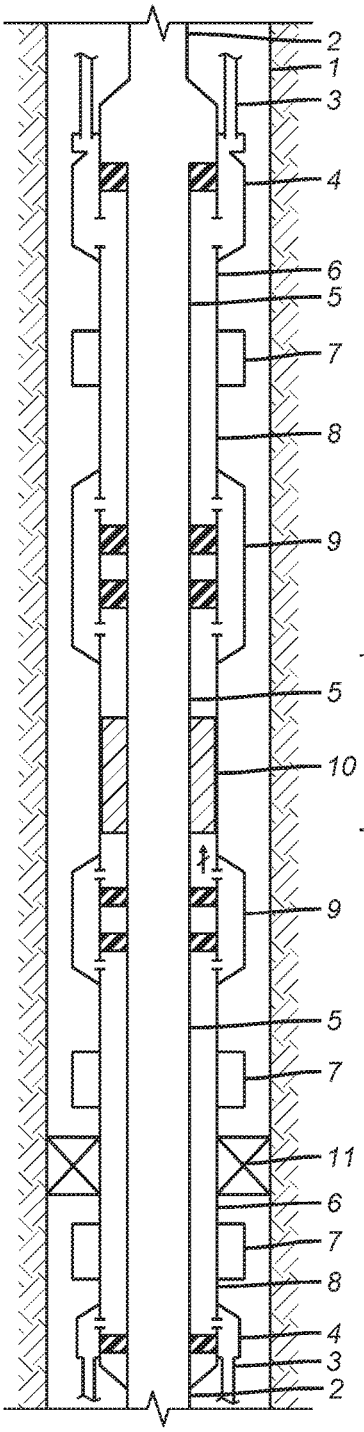
FIG. 2 is the view of FIG. 1 with the valve in the conduit in the closed position after the gravel packing so that adjacent zones are isolated for production.
Figure 3:
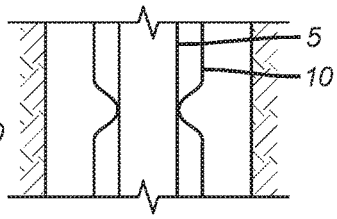
FIG. 3 shows closure of the auxiliary conduit with movement of the conduit wall.

FIG. 1 shows an open hole 1 that has a screen base pipe 2 that supports one or more isolation packers 11 that separate producing zones, although only a single zone is fully illustrated. Portions of an adjacent zone can be seen in the form of communication tubing 4 that appears above and below the packer 11 and thus is shown extending into multiple zones. The base pipes 2 are connected with couplings 7 and communications mandrels 5 to make a continuous string that supports the screens that are not shown. The auxiliary conduits 3 extend through either the body or seal of the packers 11 with the flow through the packer 11 illustrated with a series of arrows. In each conduit 3 there is a valve member 10 that during running in leaves each conduit 3 open to pass gravel between zones on opposed sides of each packer 11. The member 10 is preferably a high temperature shape memory polymer that responds to temperatures of the surrounding well fluid to cross its transition temperature and change shape into the FIG. 2 shape where the conduits 3 are obstructed. The heat can come from well fluid temperatures that occur naturally or the temperature can be artificially enhanced with heat from a heater or from an induced reaction that is exothermic or from other heat sources brought into the vicinity of the member 10. The artificial addition of heat just brings the member 10 to its critical temperature faster for closing off the conduits 3 on one or opposed sides of a packer 11 for full zonal isolation when the packer 11 is set. The packers can be unset during gravel packing so that multiple zones can be gravel packed together followed by setting the packers 11 followed by using the heat in well fluid to automatically shut the conduits 3 for full zonal isolation. FIG. 1 shows various components such as communication housing 4, top sub 8, isolation valve housing 9 and bottom sub 6 all of which are part of the conduits 3 that overly the base pipe 2 and associated screens that are not shown that overly the base pipes 2. Member 10 is shown as a valve member inside the conduit 3 that with a crossing of the transition temperature closes it. Alternatively, as shown in FIG. 3, the conduit 3 itself can be made from a similar material so that the crossing of the critical temperature from well fluid makes the shape change that ensues change the tubular wall configuration and creates a closure for zonal isolation to become effective at the packers 11 because the conduits that span the set packer are effectively closed. The members 10 in each zone can be responsive to the same or different well fluid temperatures so that closure of members 10 in adjacent zones can occur at the same or different times. This allows sequential closures of the conduits 3 in an uphole or downhole sequence or in another desired sequence. Adding heat locally can also control the order of closures.

It should be noted that the communication housings 4 allow entry or exit of gravel into the surrounding annulus for the gravel packing.

The advantage of the present invention is the automatic operation of the closures in the conduits 3 that then make possible the zonal isolation at the packers 11 to allow selective production or injection into selected zones or full isolation of such zones if desired. With proper screen valves individual zones can be separately produced or multiple zones can be produced together. The closures can be situated anywhere on the conduits 3 between isolation packers 11 with preferably each conduit 3 having one or more members in a given packer 11 interval with the use of multiple members providing further assurance that there is tight closure in the conduits between the zones. Apart from a shape change that plugs the conduits 3 the shape of the conduits 3 can change when the shape memory polymer is used for the conduit wall itself and reverts to a shape above the critical temperature that effectively closes the conduit. The member material can be shape memory alloy in an alternative design. The automatic operation of the closures for the conduits 3 can save time in getting the isolation of zones accomplished so that the next phase can be started that much faster. In the event additional time is needed before the conduits 3 close, fluid can be circulated with the gravel that is refrigerated to temporarily suspend the closure to allow time for effective completion of the gravel packing.

We claim:

1. An isolation method, comprising:

running in an assembly of screens separated by at least one packer with at least one auxiliary conduit passing through said packer and extending into adjacent zones defined by said packer, said conduit comprising a wall to define a passage;

setting said at least one packer subsequent to said running in to thereby isolate said adjacent zones from each other;

gravel packing at least one of said adjacent zones;

after said gravel packing is completed, automatically closing said conduit principally in response to a thermal signal from surrounding fluid in said zones and outside said conduit without the surrounding fluid outside said conduit contacting a closure within said conduit, said closing occurring by shape change of said closure at a predetermined temperature.

2. The method of claim 1, comprising:

running said conduit through a body or a seal of said packer.

3. The method of claim 1, comprising:

using a shape memory polymer or alloy as part of said conduit for selective closure of said conduit.

4. The method of claim 3, comprising:

raising the temperature of said polymer or alloy above the critical temperature for a shape change that results in closure of said conduit.

5. The method of claim 4, comprising:

adding or removing heat from well fluids in said zones to control the timing of said shape change.

6. The method of claim 4, comprising:

using a heater or an exothermic reaction to accelerate a closure of said conduit.

7. The method of claim 1, comprising:

closing said conduit in one or more zones.

8. The method of claim 1, comprising:

providing multiple conduits extending into multiple zones.

9. The method of claim 8, comprising:

making closures or conduit material in different zones responsive to change shape at the same or different temperatures.

10. The method of claim 9, comprising:

controlling the sequence of conduit closing to occur in an uphole, downhole or random pattern.

11. The method of claim 1, comprising:

gravel packing with said packer set or unset.

12. The method of claim 1, comprising:

extending multiple conduits into multiple zones through a plurality of packers;

automatically closing said multiple conduits thermally for isolation of a plurality of said zones from each other.

13. The method of claim 1, comprising:

using, in conjunction with said closure in said conduit that changes shape at a predetermined temperature to close said conduit, a conduit wall material changing shape.

14. An isolation method, comprising:

running in an assembly of screens separated by at least one packer with at least one auxiliary conduit passing through said packer and extending into adjacent zones defined by said packer, said conduit formed by a wall inside surface that defines an unobstructed passage having an initial dimension and said wall having an outside surface with said inside and outside surfaces being a shape memory material;

setting said at least one packer subsequent to said running in to thereby isolate said adjacent zones from each other;

gravel packing at least one of said adjacent zones;

allowing some gravel to contact said inside surface defining said passage during said gravel packing;

collapsing, after said gravel packing and in response to a thermal signal, said inside and outside surfaces of said wall to reduce the internal dimension of said unobstructed passage by moving spaced portions of said inside and outside surfaces at a predetermined temperature, said collapsing closing said passage defined by said conduit as portions of said inside and outside surfaces that were spaced from each other to define said initial dimension move to where said inside surfaces contact each other to obstruct said passage to reduce said initial dimension.

* * * * *